United States Patent [19]

Arai

[11] 4,133,609

[45] Jan. 9, 1979

[54] CHARGE-ERASING DEVICE FOR ELECTROPHOTOGRAPHIC COPYING APPARATUS

[75] Inventor: Kenichi Arai, Toyokawa, Japan

[73] Assignee: Minolta Camera Kabushiki Kaisha, Azuchimachi, Japan

[21] Appl. No.: 757,806

[22] Filed: Jan. 10, 1977

Related U.S. Application Data

[63] Continuation of Ser. No. 575,744, May 8, 1975, abandoned.

[30] Foreign Application Priority Data

May 15, 1974 [JP] Japan ..... 49-54877

[51] Int. Cl.[2] ..... G03G 15/00

[52] U.S. Cl. ..... 355/3 R; 355/7; 355/71

[58] Field of Search ..... 355/3 R, 7, 71

[56] References Cited

U.S. PATENT DOCUMENTS

| | | | |
|---|---|---|---|
| 3,578,970 | 5/1971 | Michaud | 250/325 |
| 3,724,940 | 4/1973 | Koizumi | 355/3R |
| 3,724,942 | 4/1973 | Gibson et al. | 355/3 R |
| 3,792,913 | 2/1974 | Simmons | 355/7 |
| 3,869,202 | 3/1975 | Tabata et al. | 355/3 R |
| 3,901,593 | 8/1975 | Kogiso et al. | 355/3 R |

OTHER PUBLICATIONS

IBM Tech. Disclosure Bull.; vol. 16, No. 4, pp. 1262–1263; Bellamy; Sep. 1973.

*Primary Examiner*—Richard L. Moses
*Attorney, Agent, or Firm*—Wolder, Gross & Yavner

[57] ABSTRACT

A charge-erasing unit for an electrophotographic reproducing machine utilizing a single, continuously illuminated light source during the reproduction cycle for erasing the charges in selected intermediate and marginal areas of a moving photosensitive member. Selection of the erasure areas is controlled by use of at least one narrow shutter movable into various positions in accordance with the size of the image reproduced, the shutter being completely withdrawn during passage of the intermediate area under the light source.

4 Claims, 13 Drawing Figures

CHARGE-ERASING DEVICE FOR ELECTROPHOTOGRAPHIC COPYING APPARATUS

This is a continuation of application Ser. No. 575,744, filed May 8, 1975, now abandoned.

BACKGROUND OF THE INVENTION

This invention relates to an electrophotographic reproducing apparatus and more particularly to a charge-erasing device for use in an electrophotographic apparatus in which an image of a suitable reproduction size is formed by exposure to a pattern of light.

In general, with the electrophotographic reproducing apparatus of the type described, a charging device operates continuously during rotation of a photosensitive body upon commencing a sequence of reproduction cycles, so that there is uniform charging not only of an image-forming portion of the surface of the photosensitive body, but also of the portion of the surface intermediate the aforesaid image-forming portion and a subsequent image portion, and (for narrow copy sizes) the nonimage-forming portions at both sides of the aforesaid image-forming portion. Thus, when such a charged surface is subjected to development, the nonimage-forming portions (i.e., those having no bearing on reproduction of the original) electrostatically attract toner, so that the amount of toner required therefor is used in vain and the load on a residual-toner cleaning device becomes excessive.

For this reason, there has been proposed a charge-erasing device in which a charge-erasing light source is located at the nonimage-forming portion between a charging station and an exposure station. By controlling the turn-on and turn-off operations of the charge-erasing light source in association with rotation of the photosensitive body, as well as the required reproduction size, one can erase charges previously deposited on the nonimage-forming portion as it passed the charging station. Such a device suffers from disadvantages, however, in that since a certain period of time is required for energizing the aforesaid charge-erasing light source to full power at the instant when illumination by the light source is desired, there accordingly results insufficient radiation of the light on the nonimage-forming portion although the intent is to have the charge thereon erased by means of the light source. Thus, there occurs a failure to completely erase the charge on the leading edge of the nonimage-forming portion.

The present invention is therefore directed to avoiding the above-mentioned shortcomings.

SUMMARY OF THE INVENTION

The object of the invention is to provide a charge-erasing device for use in an electrophotographic apparatus of the type having a precharged, movable photosensitive body within it upon which there are produced latent charge images representative of a document to be copied. In such apparatus a succession of spaced latent charge images are formed by exposure to a light pattern in a reproduction size which is selectively equal in width to the photosensitive body or narrower than same. The space between the successive images and also the edges of the sensitive body beyond images of the smaller size, when this last is selected, are representative of nonimage-forming portions of the photosensitive member. According to the invention, a single charge-erasing light source is supplied which provides continuous illumination. The light source is encompassed within a case having a slit with a length equal to the width of the photosensitive body, and at least one adjustable shutter blade is provided which cooperates with the slit, the blade having a light-shielding portion corresponding in length to the width of the narrower reproduction size. A charge-erasing range control means responsive to predetermined movement of the sensitive body and to selection of the narrower reproduction size is operable to adjust the placement of the shutter blade in relation to the slit. In this fashion the opening afforded by the slit is varied such that light from the source passes through selectable parts of the slit for purposes of erasing charges in the above-mentioned nonimage-forming portions of the photosensitive body. In one form, there is but a single shutter blade having two light-shielding portions, one portion having a length corresponding to the narrower reproduction size and another portion being slightly greater in length than the slit. In other forms, there are at least two shutter blades, one having a length equal to the width of the narrow reproduction size and the other shutter blades having notched central portions to accommodate the first blade (or another notched blade which accommodates the first blade, but has an overall length corresponding in width to an image of intermediate size).

In the first form, by moving the single blade clear of the slit, erasure of the space between images is achieved and by moving the portion of the single blade coextensive with the slit to a position over the opening, nonerasure of any charges can be achieved so as to permit making copies in the largest reproduction size, and by moving the blade to an intermediate position, erasure of just the edge areas is provided for puroposes of reproduction in the narrower size. Similarly, in the other forms, by judicious positioning of two or more of the blades, clearance of the space between images and variable marginal spaces (according to selection of a small, intermediate or large size) is made possible in simple fashion.

Other objects of the invention will be evident by reading the following description of the invention taken in conjunction with the drawing.

Figure 1:
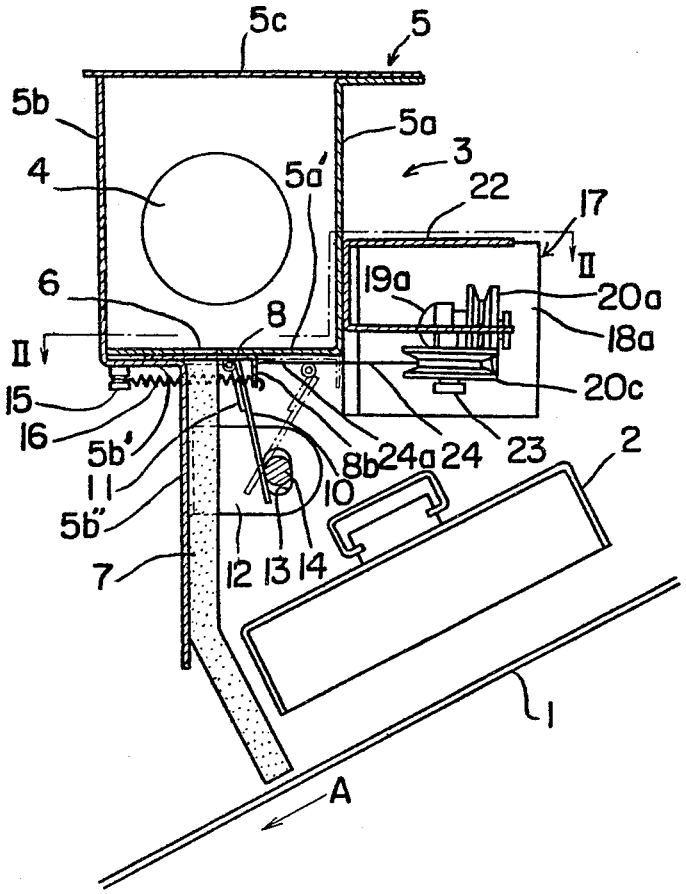
FIG. 1 is a cross-sectional view of a charge-erasing device according to the present invention.

In these figures, 1 is a photosensitive body such as a cyclically revolved endless web, i.e., a photoconductive belt or drum, 3 is a charge-erasing device having a charge-erasing lamp 4 in a housing 5 with a slit 6. A shutter blade 8 is positioned by charge-erasing range control means 17. 25,26 are shutter blades of a second embodiment, and 27, 28, 29 are shutter blades of a third embodiment.

DETAILED DESCRIPTION OF THE INVENTION

Figure 2:
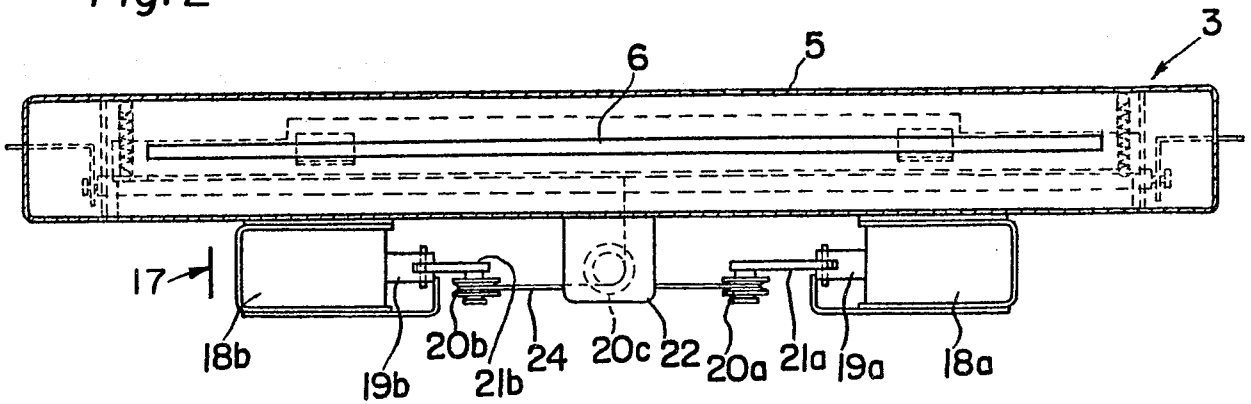
FIG. 2 is a cross-sectional view taken along the line II—II of FIG. 1.
Figure 3:
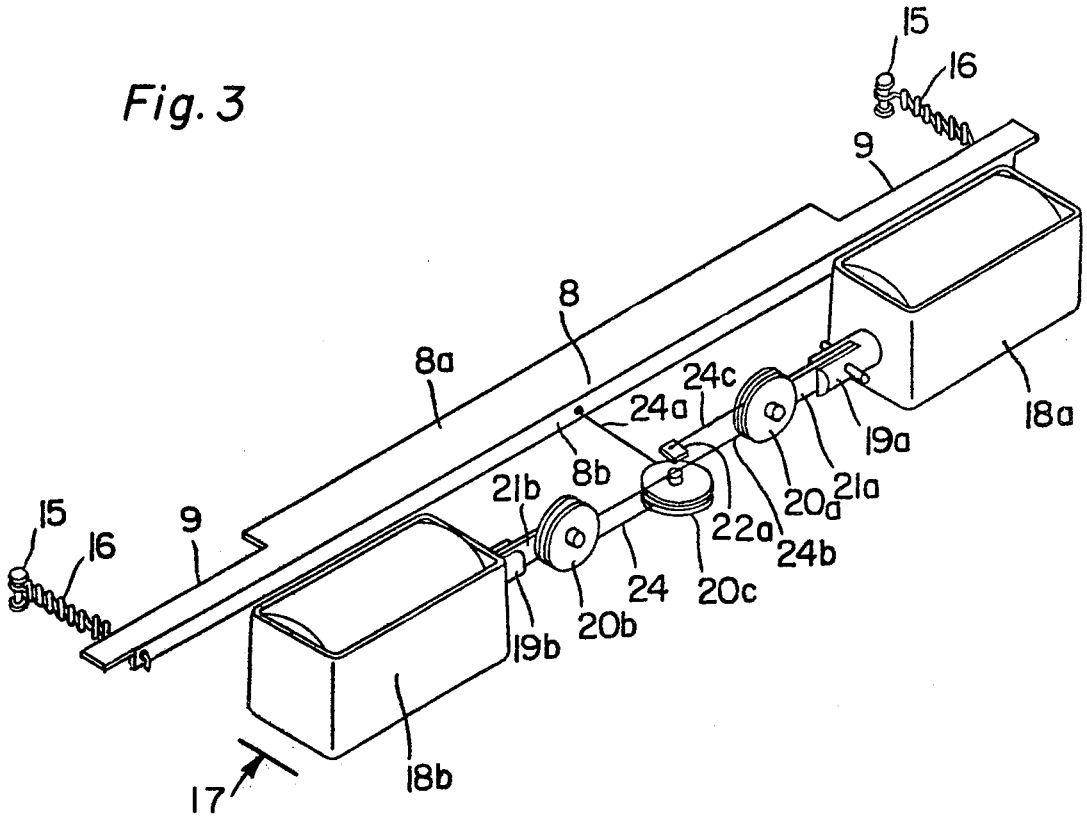
FIG. 3 is a perspective view of a shutter blade and a charge-erasing range control means.

Referring to FIGS. 1 to 3, a photosensitive belt 1 having a photoconductive layer (not specifically shown) on its surface is rotatably mounted for movement in the arrow direction A, being trained in an endless fashion around supporting rollers (not shown). A charging corona unit 2 for applying uniform charges to the surface of the photoconductive layer and (not shown, but known) an optical system for forming an image, a corona unit for transferring the image, and a residual toner cleaning device are provided in the neighborhood of the sensitive belt 1.

A charge-erasing device 3 is shown in FIGS. 1–3, which consists of a charge-erasing lamp 4 having a length substantially the same as the width of photosensitive belt 1 and being adapted for continuous illumination, a housing 5 encompassing lamp 4, a light guide 7 for directing the light from lamp 4 onto photosensitive belt 1, a shutter blade 8 for controlling the charge-erasing range, and a charge-erasing range control means 17 adapted to operate the shutter blade 8.

The housing 5 consists of side plates 5*a*, 5*b* and a lid 5*c*, side plate 5*a* being bent inwardly at a right angle to form a bottom portion 5*a*′, and side plate 5*b* being bent inwardly to form a bottom portion 5*b*′ underlying the part of bottom portion 5*a*′ remote from the bend in side plate 5*a*, and being further bent downwardly to form a vertical portion 5*b*″. At the same time, there is provided in the bottom portion 5*a*′ of side plate 5*a* a slit 6 which runs parallel to lamp 4, the length of slit 6 having the same dimension as the width of photosensitive belt 1, while the width of slit 6 has the same dimension as the thickness of light guide 7. Light guide 7 consists of a plurality of parallel light-transmitting bodies made of transparent synthetic resin such as acrylic resin or the like, with the top end thereof being located within the confines of slit 6 and the bottom end thereof located above photosensitive member 1, immediately downstream of charging corona unit 2. Furthermore, the base portion of light guide 7 is located by means of the vertical portion 5*b*″ of side plate 5*b*.

The shutter blade 8 moves back and forth in the horizontal direction against the back surface of the bottom portion 5*a*′ of housing 5 to thereby open or close slit 6 for controlling the charge-erasing range. The length of blade 8 is the same as the length of slit 6, while the width thereof is almost twice the width of slit 6 plus some allowance. In addition, relatively short cutaways, 9,9′ are provided on one side of blade 8 near each end, the depths of these cutaways having the same dimension as the width of slit 6. In other words, the length of shutter blade 8, as well as the length of a central portion 8*a* defined by the cutaways 9,9′, depend on the reproduction sizes available in the reproducing apparatus. For instance, in case the reproduction size may be selected between B4 size (257 × 363 mm) and A4 size (210 × 297 mm), the length of shutter blade B should be the same in dimension as the width of the B4 size, while the length of the central portion 8*a* should be of the same dimension as the width of the A4 size. The tip portion of shutter blade 8 may be inserted in slidable relation within the slot defined by a space between the bottom portions 5*a*′ and 5*b*′ of housing 5, with the rear portion (right side in FIG. 1) being connected to the top end of a rocking plate 10 by means of a hinge 11 in a manner such that shutter blade 8 may move back and forth in the horizontal plane in response to operation of the charge-erasing range control means 17 to be described later. The lower end of rocking plate 10 is secured to a shaft 14 having each of its ends loosedly fitted in an elongated hole 13 in a respective bracket 12 mounted on the vertical portion 5*b*″ of housing 5, so that rocking plate 10 may rock about shaft 14 upon horizontal movement of shutter blade 8. At each extremity of shutter blade 8, one end of a respective return spring 16 is secured to an angled extension piece 8*b* — formed by bending the rear part of shutter blade 8 downwardly. The other end of each spring 16 is secured by means of a terminal 15 to the lower surface of the bottom portion 5*b*′ of housing 5, and thus springs 16 normally bias blade 8 to the left as viewed in FIG. 1.

The charge-erasing range control means 17 (best seen in FIG. 2 or FIG. 3) includes solenoids 18*a*, 18*b* respectively mounted on housing 5 near opposite ends of side 5*a*. Plungers 19*a*, 19*b* of these two solenoids are directed inwardly, and horizontal arms 21*a*, 21*b* bearing pulleys 20*a*, 20*b* rotatably mounted at their tips are respectively secured to the plungers 19*a*, 19*b*. A pulley 20*c* is rotatably supported by means of a shaft 23 on the lower arm of a U-shaped bracket 22 attached to the outer surface of side plate 5*a* at its central portion, while one end 24*a* of a flexible cord 24 is secured to the center of angled extension piece 8*b* of shutter blade 8. The central portion 24*b* of cord 24 is wound around pulleys 20*c*, 20*b* by one turn, with the other end 24*c* of the cord being secured to a part 22*a* projecting from bracket 22. The above-mentioned solenoids 18*a*, 18*b* are each connected to a source of electrical energy by a switch (known, but not shown) operated by a respective cam (not shown) which is adapted in known fashion to rotate in accordance with the respective reproduction size (B4 size and A4 size in this exemplary apparatus). The cams are provided in a drive section (not shown) of the photosensitive belt 1, and thus the solenoids 18*a*, 18*b* are operated according to signals from the aforesaid cam-operated switches as belt 1 rotates.

A detailed description of the operation of the charge-erasing device 3 having the aforesaid arrangement will now be given.

Figure 4A:
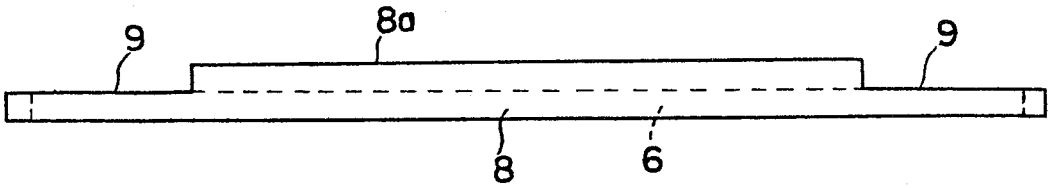
FIG. 4(*a*), (*b*) and (*c*) show plan views illustrating the operation of the shutter blade.
Figure 4B:
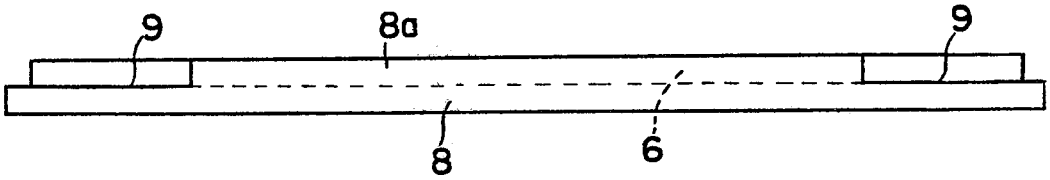

Initially, referring to the case of reproduction in size A4, the plungers 19*a*, 19*b* of solenoids 18*a*, 18*b* are in their normal condition, i.e., have advanced toward the center (see FIG. 2), shutter blade 8 therefore having been pulled — by means of return springs 16 — to a position such that slit 6 in housing 5 is fully closed (refer to FIG. 4*a*). When a print switch (not shown) on the reproduction apparatus is depressed, then photosensitive belt 1 starts to rotate in the direction of arrow A, while the charging corona unit 2 and charge-erasing lamp 4 are activatd, and in addition the aforesaid cam begins to rotate. Firstly, when solenoid 18*a* is turned on by means of an initial signal from its related cam, plunger 19*a* is retracted. Shutter blade 8 having one end of string 24 secured thereto is thus moved in the horizontal direction against the tension of return springs 16, the movement being to the right as viewed in FIG. 1 and by a distance equal to that by which plunger 19*a* has been retracted. This distance is so designed that the central portion 8*a* and cutaways 9,9′ in shutter blade 8 will be located over slit 6 (refer to FIG. 4*b*). Under these conditions, light from lamp 4 is introduced through the cutaways 9,9′ and directed by means of the light guide 7 to thereby expose only the two side portions of photosensitive belt 1, i.e., the nonimage-forming portions at both side edges existing at the time of reproduction of the narrow A4 size. The illumination therefore erases charges on the side edge nonimage-forming portions, while the central portion of photosensitive belt 1 associated with reproduction, i.e., the image-forming portion thereof, is shielded against light by the central piece 8a of shutter blade 8, so that charge erasing will not take place there.

Figure 4C:
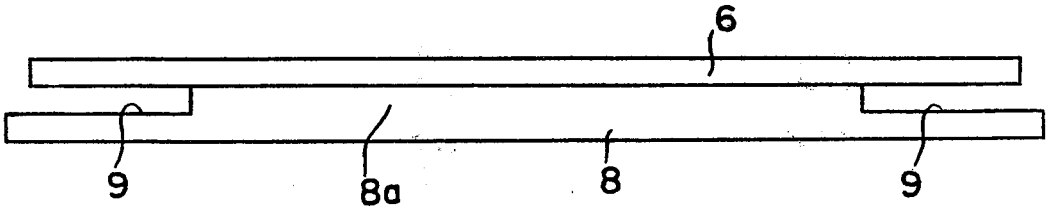

Furthermore, when rotation of photosensitive belt 1 causes the terminal end of the image-forming portion to reach the position where light guide 7 of charge-erasing device 3 is located above it, then, in synchronism therewith solenoid 18b is turned on by means of a second signal from a switch operated by its related cam. Plunger 19b is thus retracted and shutter blade 8 moves further in the horizontal direction against the tension of return springs 16 (again to the right as viewed in FIG. 1), and by a distance equal to the retraction of plunger 19b. This distance, added to the retraction distance of plunger 19a, is such that shutter blade 8 fully opens slit 6 (refer to FIG. 4c). In this condition, the illumination from lamp 4 will not be shielded by shutter blade 8 to any degree, but through slit 6 will be directed by light guide 7 to expose the entire width of photosensitive belt 1 — i.e., will erase charges on the nonimage-forming portion between one image area and the next. For termination of charge erasing on the nonimage-forming portion, solenoid 18a alone is de-energized in response to another signal from the switched operated by its related cam, which has been set commensurate with the distance advanced by photosensitive belt 1. De-energization causes plunger 19a to be released so that return springs 16 pull shutter blade 8 to the position shown in FIG. 4b in order to effect charge erasing of the side edge nonimage-forming portions of photosensitive belt 1. Thereafter, the charge-erasing range control means 17 will repeat the above-described operation in accordance with the number of copies required.

Upon completion of the reproduction, however, both solenoids 18a, 18b are released from the energized condition, shutter blade 8 then being pulled by means of return springs 16 to the initial condition shown in FIG. 4a. While solenoid 18a was operated first in the above description, solenoid 18b may be operated first, if desired.

In case of reproduction to size B4, charge erasing of the above-mentioned side edges of the nonimage-forming portions will not be required, since the width is greater than that of A4 size. Hence, solenoids 18a, 18b should be operated simultaneously by a cam having an appropriately changed setting, such that shutter blade 8 may be shifted in one movement from the fully closed condition shown in FIG. 4a to the fully opened condition shown in FIG. 4c when "in-between" areas of belt 1 are passing under slit 6.

Figure 5A:
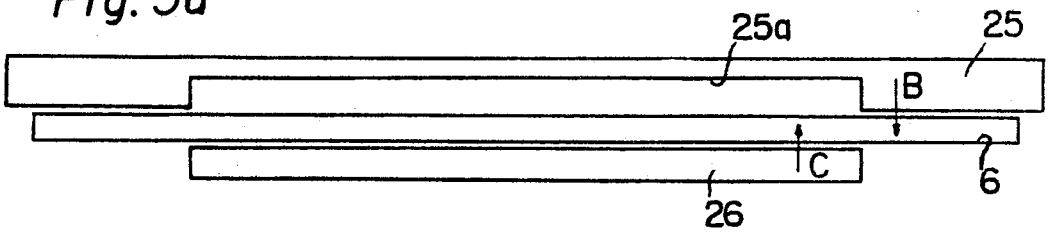
FIGS. 5(*a*), (*b*) and (*c*) show plan views illustrating the operation of a modification having two shutter blades.
Figure 5B:
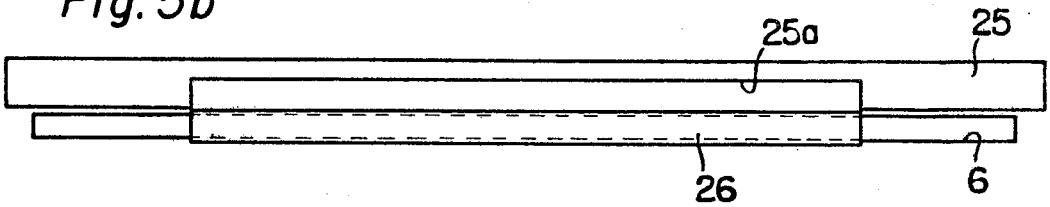
Figure 5C:
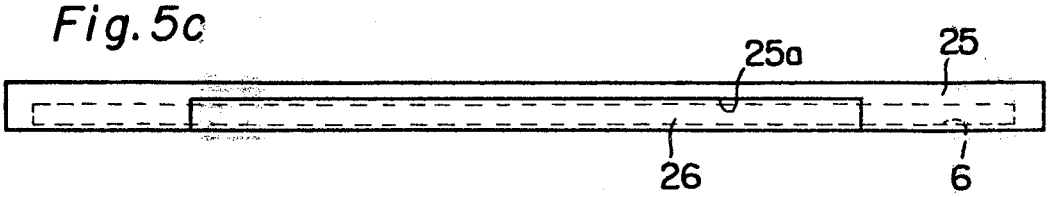

FIGS. 5a, 5b, 5c show a modified embodiment of the shutter system, in which there are provided two blades: a first shutter blade 25 formed with an elongated cutaway 25a and a second shutter blade 26 identical in size and shape to the aforesaid cutaway 25a. The second shutter blade 26 corresponds in size to the central portion 8a of shutter blade 8 of the first embodiment. The first shutter blade 25 is so designed as to move in the direction of arrow B and the second shutter blade 26 moves in the direction of arrow C, respectively. FIG. 5a shows the fully opened condition (erasing the charge on the in-between nonimage-forming portion). FIG. 5b shows the condition where only the second shutter blade 26 closes slit 6 (the charges at the side edges of the nonimage-forming portion being erased, i.e., as in the case of reproduction of size A4), and FIG. 5c shows the fully closed condition (as for reproduction of size B4).

Figure 6A:
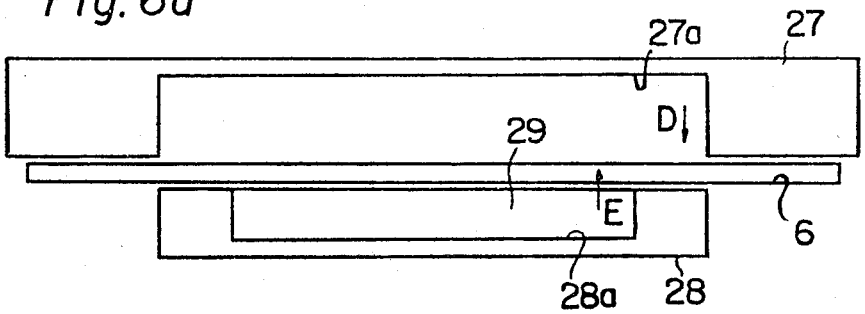
FIGS. 6(*a*), (*b*), (*c*) and (*d*) are explanatory views of another modification having three shutter blades.
Figure 6B:
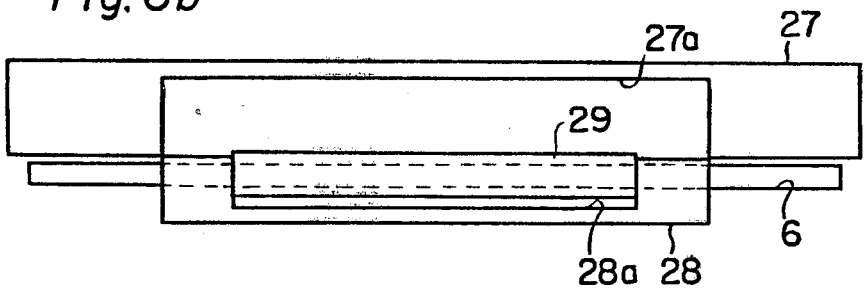
Figure 6C:
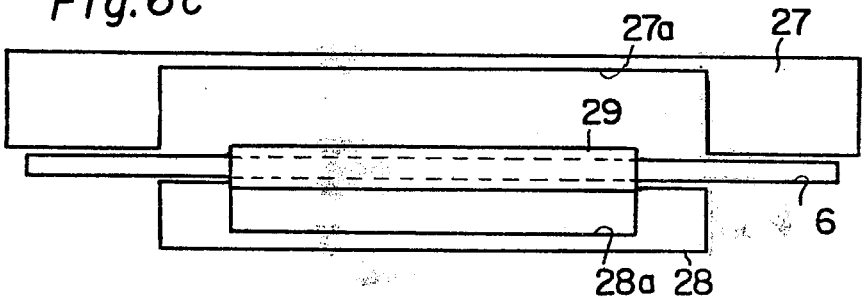
Figure 6D:
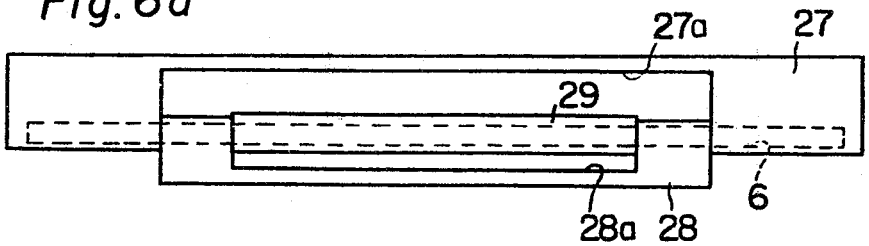

FIGS. 6a, b, c, and d show modifications of the shutter blade according to the invention to permit selection from among B4 size, A4 size, and B5 size (182 × 257 mm). Those modifications are composed of a first shutter blade 27 formed with a cutaway 27a, a second shutter blade 28 having the same size and shape as that of the above cutaway 27a and being provided with a cutaway 28a, and a third shutter blade 29 having a size and shape equal to those of cutaway 28a. The length of the second shutter blade 28 corresponds to the width of the A4 size, while the length of the third shutter blade corresponds to the width of the B5 size. The first shutter blade 27 is so designed as to move in the direction of arrow D, while the second shutter blade 28 and the third shutter blade 29 are so designed as to move in the direction E, respectively. FIG. 6a shows the fully opened condition (erasing the charges on the in-between nonimage-forming portion), and FIG. 6b shows the condition where the second shutter blade 28 and the third shutter blade 29 close slit 6 (erasing the charge on the side edges of the nonimage-forming portion at the time of reproduction of A4 size), while FIG. 6c shows the condition where only the third shutter blade 29 closes slit 6 (erasing the charge on the side edges of the nonimage-forming portion in the case of reproduction of B5 size). In addition, FIG. 6d shows the fully closed condition (reproduction of B4 size). In this embodiment, three solenoids are provided to operate respective ones of the aforesaid shutter blades 27, 28, 29. Since a flexible string 24 is used for transmitting operation of each solenoid to the respective one of the related shutter blades 27–29, the aforesaid solenoids may be located in any suitable position, as the situation may require.

The above-described charge-erasing device 3 may be modified within the scope of the spirit of the present invention. For instance, a cylindrical body having a reflecting surface in the interior thereof may replace the aforesaid light guide 7. Likewise, if slit 6 can be located in a position close to sensitive belt 1, light guide 7 may be omitted entirely.

As is apparent from the foregoing description of the charge-erasing device according to the present invention, a charge-erasing light source provides continuous illumination and a shutter blade is mechanically controlled in accordance with the rotation of the sensitive body and the desired reproduction size, for completely erasing charges on nonimage-forming portions, both in the areas between images and also at the sides, thereby eliminating excessive consumption of toner, with the resulting saving in the load on the residual-toner cleaning device. Thus, this arrangemet provides highly valuable commercial advantages.

What is claimed is:

1. In a charge-erasing device for use in an electrophotographic apparatus of the type in which a plurality of latent charge images are formed successively on a movable, precharged photosensitive member by exposure to a light pattern representative of a document to be copied, the apparatus including means for selectably generating the pattern in at least three reproduction sizes, a first one of said sizes having a width substantially commensurate with that of the sensitive member and the second and third sizes being progressively narrower;

non-image forming portions of said photosensitive member being represented by the portion between said latent charge images and also by the edge areas of the photosensitive member beyond images of the smaller sizes, when such smaller size is selected, the precharging being performed by a charging member adjacent to the photosensitive member;

the improvement comprising a charge-erasing light source which provides continuous illumination, a case encompassing said light source and having a slit therein with a length substantially equal to the width of the photosensitive member and located remote therefrom;

a light-transmitting means for conducting light passing through the slit to a position proximate to the photosensitive member, said light transmitting means extending from the slit to a position proximate to the photosensitive member and having a first end opposite the slit and a second end immediately opposite the surface of the photosensitive member so that said slit is located remote from the photosensitive member, a first shutter blade immediately adjacent to and cooperating with said slit and being a rectangular blade corresponding in length to the width of said pattern of the third, narrowest size;

a second shutter blade coplanar with said first shutter balde and having a length equal to the width of the pattern of the second size, together with a cutaway portion on one side thereof equal in dimensions to those of the first shutter blade;

and a third shutter blade coplanar with the other shutter blades and having alength at least equal to that of the slit, together with a cutaway portion on one side thereof equal in dimensions to those of the second shutter blade thereby permitting nesting of the first shutter blade within the cutaway portion of the second shutter blade and nesting of the second shutter blade within the cutaway portion of the third shutter blade.

2. In a charge-erasing device for use in an electrophotograhic apparatus of the type in which a succession of latent charge images are formed on a precharged, movable photosensitive member by exposure to a light pattern in a reproduction size which is selectably equal in width to the photosensitive member or narrower than same, non-image forming portions of said photosensitive member being represented both by the portion between the images and also by the edge areas of the sensitive member beyond images of the smaller size, when the last mentioned size is selected, the precharging being performed by a charging member adjacent to the photosensitive member, the improvement comprising a single charge-erasing light source which provides continuous illumination, a case encompassing said light source and having a slit therein with a length equal to the width of the photosensitive member and located remote therefrom, at least one adjustable shutter blade cooperating with the slit and having a light shielding portion corresponding in length to the width of the narrower reproduction size, light transmitting means for conducting light passing through the slit to a position proximate to the photosensitive member, said light transmitting means having a first end opposite the slit and a second end opposite the surface of the photosensitive member;

a charge-erasing range control means operable to adjust the placement of said shutter blade in relation to the slit varying thereby the opening afforded by said slit, whereby light from said source passes through selectable parts of said slit for erasing charges in non-image forming portions of said photosensitive member; and auxiliary shutter means having at least one portion thereof with a length complementary to that of the light-shielding portion of said at least one shutter blade;

said light shielding portion being a first portion of a single shutter blade, said auxiliary shutter means being a further, discrete light-shielding portion thereof with a length at least as great as that of said slit, and said range control means being adapted to: (a) place the further portion of the blade in light-shielding relation to the slit in response to selection of said equal width reproduction size, (b) place the first portion of the blade in light-shielding relation to the slit in response to selection of said smaller reproduction size, and (c) place the blade in a position with both portions clear of the slit in response to movement of said photosensitive member over a predetermined distance.

3. In an electrophotographic copying apparatus including an advanceable substrate and means for electrically charging said substrate and means for exposing said charged substrate to the light image of an original to produce a corresponding latent electrostatic image, a mechanism for erasing redundant charges from said substrate comprising a continuously luminous source of light disposed remote from said substrate, a case enclosing said light source and having therein remote from said substrate a transversely extending elongated slot of a length at least equal to the width of said photosensitive substrate, light conducting means extending between said slot and said substrate and having one end face proximate to and substatially registering with said slot and exposed to said light source through said slot and an opposite end face closely confronting said substrate in the area forward of said charging means in the direction of advance of said substrate and means located proximate said slot for masking selected areas of the ends of said slot whereby to vary the area of said substrate exposed to charge-erasing light transmitted by said light conducting means from said light source through said slot to said substrate.

4. In an electrophotographic copying apparatus including an advanceable substrate and means for electrically charging said substrate and means for exposing said charged substrate to the light image of an original to produce a corresponding latent electrostatic image, a mechanism for erasing redundant charges from said substrate comprising a continuously luminous source of light disposed remote from said substrate a case enclosing said light source and having an aperture defining opening therein remote from said substrate light conducting means extending between said opening and said substrate and having one end face proximate to and substantially registering with said aperture and exposed to said light source through said aperture and an opposite end face closely confronting said substrate in an area forward of said charging means in the direction of advance of said substrate and means located proximate said opening for adjusting the area of said aperture whereby to vary the area of said substrate exposed to charge-erasing light transmitted by said light conducting means from said light source through said aperture to said substrate, said aperture area adjusting means comprising a pluraity of masking blades selectively movable to overlie predetermined areas of said opening.

* * * * *

UNITED STATES PATENT AND TRADEMARK OFFICE

CERTIFICATE OF CORRECTION

PATENT NO. : 4,133,609

DATED : January 9, 1979

INVENTOR(S) : Kenichi Arai

It is certified that error appears in the above-identified patent and that said Letters Patent are hereby corrected as shown below:

[73] Assignee: Minolta Camera Kabushiki Kaisha
Osaka, Japan

Signed and Sealed this

*Third* Day of *April 1979*

[SEAL]

*Attest:*

RUTH C. MASON
*Attesting Officer*

DONALD W. BANNER
*Commissioner of Patents and Trademarks*